US010135153B2

(12) United States Patent
Besoli et al.

(10) Patent No.: US 10,135,153 B2
(45) Date of Patent: Nov. 20, 2018

(54) PHASED ARRAY ANTENNA PANEL WITH CONFIGURABLE SLANTED ANTENNA ROWS

(71) Applicant: Movandi Corporation, Newport Beach, CA (US)

(72) Inventors: Alfred Grau Besoli, Irvine, CA (US); Seunghwan Yoon, Irvine, CA (US); Ahmadreza Rofougaran, Newport Coast, CA (US); Farid Shirinfar, Granada Hills, CA (US); Sam Gharavi, Irvine, CA (US); Michael Boers, South Turramurra (AU); Maryam Rofougaran, Rancho Palos Verdes, CA (US)

(73) Assignee: Movandi Corporation, Newport Beach, CA (US)

( * ) Notice: Subject to any disclaimer, the term of this patent is extended or adjusted under 35 U.S.C. 154(b) by 160 days.

(21) Appl. No.: 15/335,179

(22) Filed: Oct. 26, 2016

(65) Prior Publication Data

US 2018/0115087 A1 Apr. 26, 2018

(51) Int. Cl.
*H01Q 21/22* (2006.01)
*H01Q 1/24* (2006.01)
(Continued)

(52) U.S. Cl.
CPC ..... *H01Q 21/22* (2013.01); *H01Q 1/241* (2013.01); *H01Q 3/06* (2013.01); *H01Q 3/26* (2013.01);
(Continued)

(58) Field of Classification Search
CPC ..... H01Q 1/3283; H01Q 3/08; H01Q 3/26; H01Q 21/22; H01Q 1/241; H01Q 1/38; H01Q 15/02
See application file for complete search history.

(56) References Cited

U.S. PATENT DOCUMENTS 3,343,165 A * 9/1967 Sleeper, Jr. ..... G01S 13/4409 342/153
3,549,949 A * 12/1970 Granberry ..... H01Q 1/02 165/80.4
(Continued)

OTHER PUBLICATIONS

Imbert, Marc, et al. "Design and Performance Evaluation of a Dielectric Flat Lens Antenna for Millimeter-Wave Applications," *IEEE Antennas and Wireless Propagation Letters*, vol. 14, 2015. pp. 1-4.
(Continued)

*Primary Examiner* — Tho G Phan
(74) *Attorney, Agent, or Firm* — Farjami & Farjami LLP

(57) ABSTRACT

A phased array antenna panel includes a plurality of antennas and a master chip. The antennas are arranged in a plurality of antenna rows. At least one antenna row in the plurality of antenna rows is configured to be slanted in a desired angle based on signals received from the master chip. Additionally, the phased array antenna panel can include a plurality of row-shaped lenses. At least one row-shaped lens has a corresponding antenna row, and is configured to increase a gain of the corresponding antenna row. The row-shaped lens can increase a total gain of the phased array antenna panel. The row-shaped lens is configured to be slanted in a desired angle based on signals received from the master chip.

10 Claims, 11 Drawing Sheets

(51) Int. Cl.

| | |
|---|---|
| ***H01Q 3/06*** | (2006.01) |
| ***H01Q 3/26*** | (2006.01) |
| ***H01Q 19/06*** | (2006.01) |
| ***H01Q 21/00*** | (2006.01) |
| ***H01Q 21/06*** | (2006.01) |

(52) U.S. Cl.
CPC ..... *H01Q 19/06* (2013.01); *H01Q 21/0006* (2013.01); *H01Q 21/065* (2013.01)

(56) References Cited

U.S. PATENT DOCUMENTS

| | | | | |
|---|---|---|---|---|
| 4,513,292 | A * | 4/1985 | Bowman | H01Q 9/285 343/795 |
| 6,999,036 | B2 * | 2/2006 | Stoyanov | H01Q 1/1264 343/757 |
| 7,595,762 | B2 * | 9/2009 | Mansour | H01Q 1/3283 343/757 |
| 2002/0165001 | A1 * | 11/2002 | Phillips | G01V 8/005 455/500 |
| 2010/0066631 | A1 * | 3/2010 | Puzella | H01Q 1/02 343/853 |
| 2014/0210668 | A1 * | 7/2014 | Wang | H01Q 3/34 342/372 |

OTHER PUBLICATIONS

Abbaspour-Tamijani, Abbas, et al. "Enhancing the Directivity of Phased Array Antennas Using Lens-Arrays" *Progress in Electromagnetics Research M*, vol. 29, 2013. pp. 41-64.

* cited by examiner

PHASED ARRAY ANTENNA PANEL WITH CONFIGURABLE SLANTED ANTENNA ROWS

RELATED APPLICATION(S)

The present application is related to U.S. patent application Ser. No. 15/225,071, filed on Aug. 1, 2016, and titled "Wireless Receiver with Axial Ratio and Cross-Polarization Calibration," and U.S. patent application Ser. No. 15/225,523, filed on Aug. 1, 2016, and titled "Wireless Receiver with Tracking Using Location, Heading, and Motion Sensors and Adaptive Power Detection," and U.S. patent application Ser. No. 15/226,785, filed on Aug. 2, 2016, and titled "Large Scale Integration and Control of Antennas with Master Chip and Front End Chips on a Single Antenna Panel," and U.S. patent application Ser. No. 15/255,656, filed on Sep. 2, 2016, and titled "Novel Antenna Arrangements and Routing Configurations in Large Scale Integration of Antennas with Front End Chips in a Wireless Receiver," and U.S. patent application Ser. No. 15/256,038 filed on Sep. 2, 2016, and titled "Transceiver Using Novel Phased Array Antenna Panel for Concurrently Transmitting and Receiving Wireless Signals," and U.S. patent application Ser. No. 15/256,222 filed on Sep. 2, 2016, and titled "Wireless Transceiver Having Receive Antennas and Transmit Antennas with Orthogonal Polarizations in a Phased Array Antenna Panel," and U.S. patent application Ser. No. 15/278,970 filed on Sep. 28, 2016, and titled "Low-Cost and Low-Loss Phased Array Antenna Panel," and U.S. patent application Ser. No. 15/279,171 filed on Sep. 28, 2016, and titled "Phased Array Antenna Panel Having Cavities with RF Shields for Antenna Probes," and U.S. patent application Ser. No. 15/279,219 filed on Sep. 28, 2016, and titled "Phased Array Antenna Panel Having Quad Split Cavities Dedicated to Vertical-Polarization and Horizontal-Polarization Antenna Probes," and U.S. patent application Ser. No. 15/335,034 filed on Oct. 26, 2016, and titled "Lens-Enhanced Phased Array Antenna Panel." The disclosures of all of these related applications are hereby incorporated fully by reference into the present application.

BACKGROUND

Phased array antenna panels with large numbers of antennas and front end chips integrated on a single board are being developed in view of higher wireless communication frequencies being used between a satellite transmitter and a wireless receiver, and also more recently in view of higher frequencies used in the evolving 5G wireless communications (5th generation mobile networks or 5th generation wireless systems). Phased array antenna panels are capable of beamforming by phase shifting and amplitude control techniques, and without physically changing direction or orientation of the phased array antenna panels, and without a need for mechanical parts to effect such changes in direction or orientation.

The ability of a phase array antenna panel to scan in a variety of directions is critical in establishing reliable wireless communications. The directionality of a phased array antenna panel can be increased by utilizing more antennas, and more phase shifters and front end chips. However, due to cost and complexity, this approach can be impractical. Thus, there is a need in the art to increase the directionality of a wireless receiver employing a phased array antenna panel without increasing the number of antennas, phase shifters or front end chips of the phased array antennal panel.

SUMMARY

The present disclosure is directed to phased array antenna panels with configurable slanted antenna rows, substantially as shown in and/or described in connection with at least one of the figures, and as set forth in the claims.

DETAILED DESCRIPTION

Figure 1A:
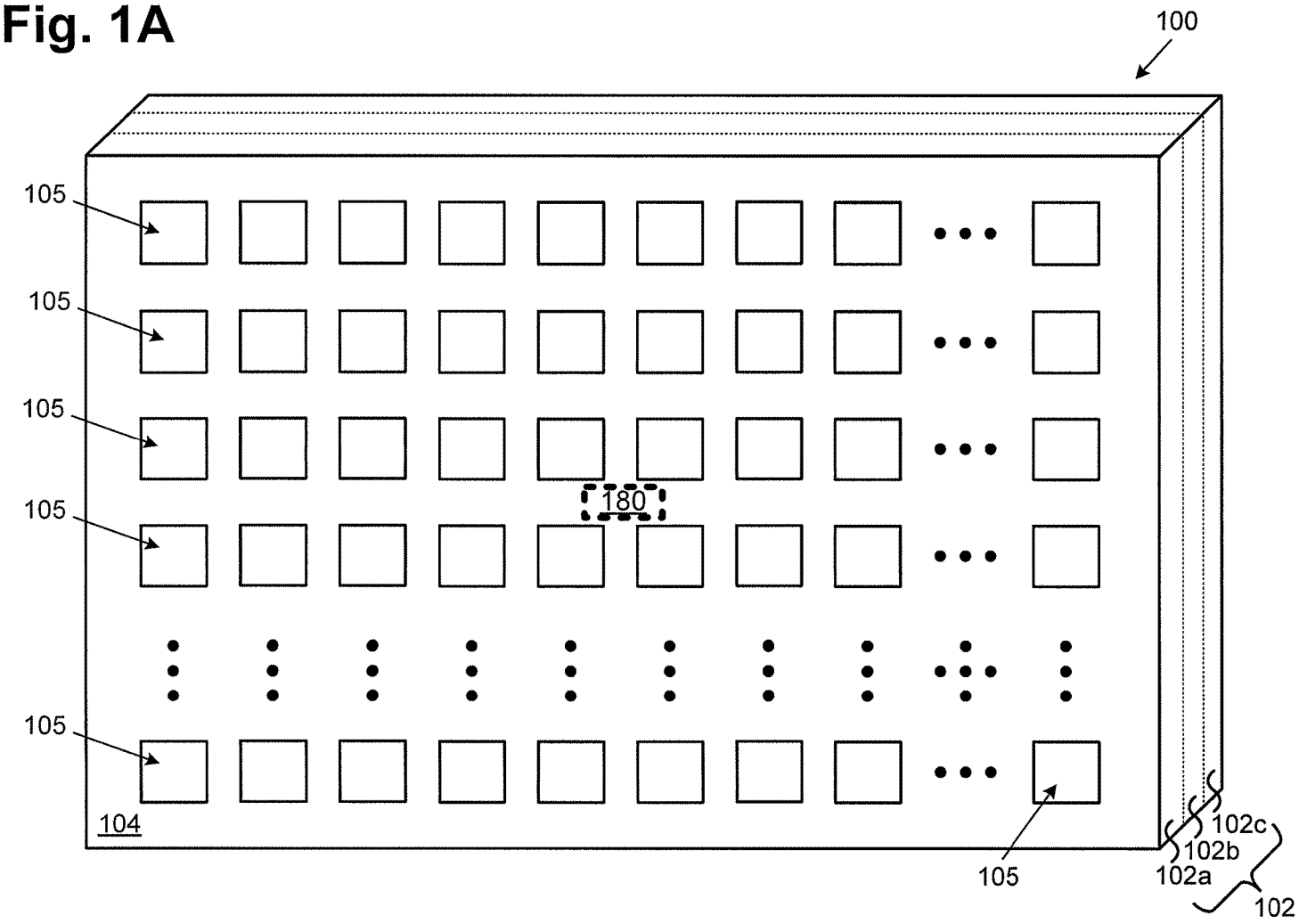
FIG. 1A illustrates a perspective view of a portion of an exemplary phased array antenna panel according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1A illustrates a perspective view of a portion of an exemplary phased array antenna panel according to one implementation of the present application. As illustrated in FIG. 1A, phased array antenna panel 100 includes substrate 102 having layers 102*a*, 102*b*, and 102*c*, front surface 104 having front end units 105, and master chip 180. In the present implementation, substrate 102 may be a multi-layer printed circuit board (PCB) having layers 102*a*, 102*b*, and 102*c*. Although only three layers are shown in FIG. 1A, in another implementation, substrate 102 may be a multi-layer PCB having greater or fewer than three layers.

As illustrated in FIG. 1A, front surface 104 having front end units 105 is formed on top layer 102*a* of substrate 102. In one implementation, substrate 102 of phased array antenna panel 100 may include 500 front end units 105, each having a radio frequency (RF) front end circuit connected to a plurality of antennas (not explicitly shown in FIG. 1A). In one implementation, phased array antenna panel 100 may include 2000 antennas on front surface 104, where each front end unit 105 includes four antennas connected to an RF front end circuit (not explicitly shown in FIG. 1A).

In the present implementation, master chip 180 may be formed in layer 102*c* of substrate 102, where master chip 180 may be connected to front end units 105 on top layer 102*a* using a plurality of control buses (not explicitly shown in FIG. 1A) routed through various layers of substrate 102. In the present implementation, master chip 180 is configured to provide phase shift and amplitude control signals from a digital core in master chip 180 to the RF front end chips in each of front end units 105 based on signals received from the antennas in each of front end units 105.

Figure 1B:
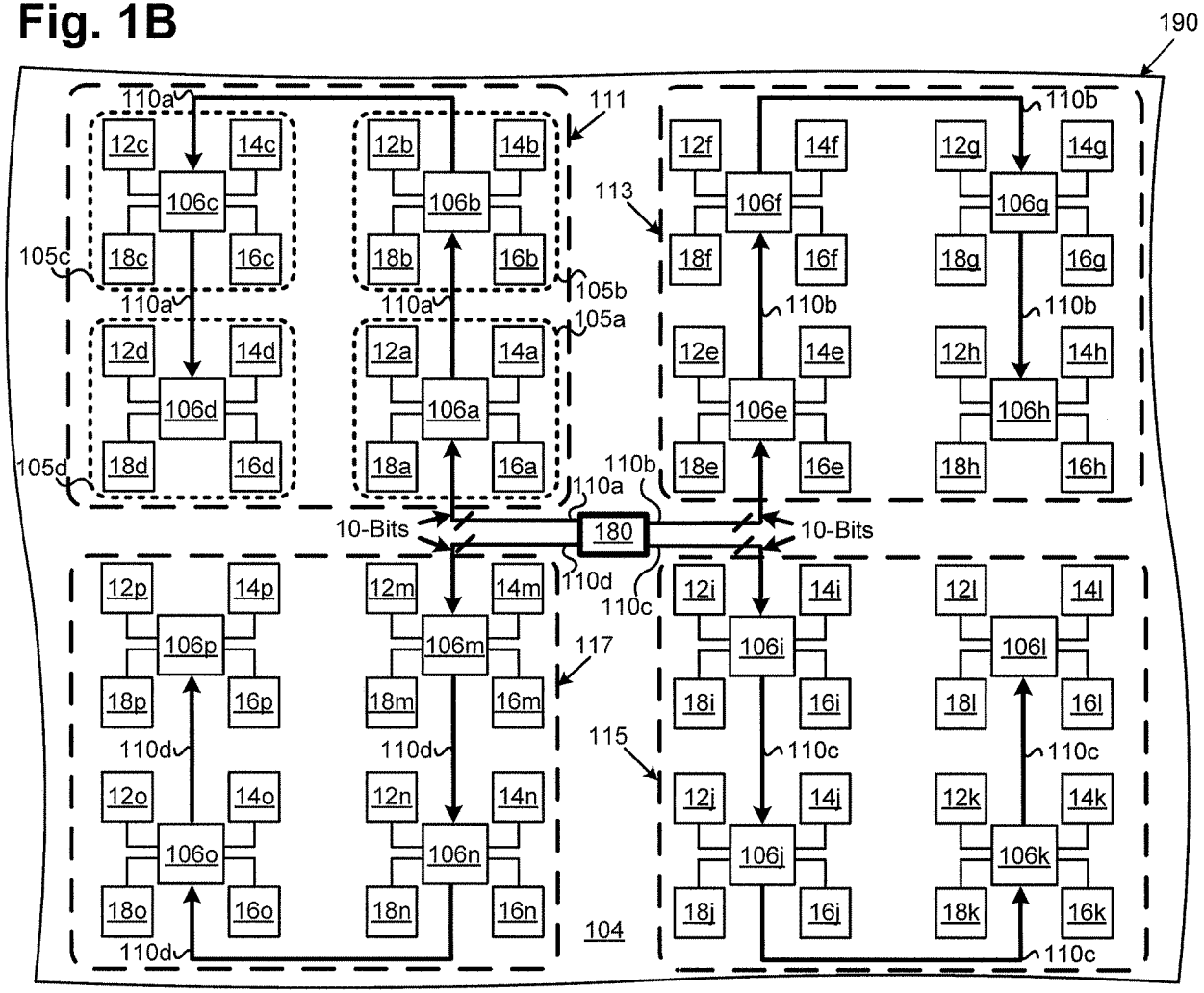
FIG. 1B illustrates a layout diagram of a portion of an exemplary phased array antenna panel according to one implementation of the present application.

FIG. 1B illustrates a layout diagram of a portion of an exemplary phased array antenna panel according to one implementation of the present application. For example, layout diagram 190 illustrates a layout of a simplified phased array antenna panel on a single printed circuit board (PCB), where master chip 180 is configured to drive in parallel four control buses, e.g., control buses 110*a*, 110*b*, 110*c*, and 110*d*, where each control bus is coupled to a respective antenna segment, e.g., antenna segments 111, 113, 115, and 117, where each antenna segment has four front end units, e.g., front end units 105*a*, 105*b*, 105*c*, and 105*d* in antenna segment 111, where each front end unit includes an RF front end chip, e.g., RF front end chip 106*a* in front end unit 105*a*, and where each RF front end chip is coupled to four antennas, e.g., antennas 12*a*, 14*a*, 16*a*, and 18*a* coupled to RF front end chip 106*a* in front end unit 105*a*.

As illustrated in FIG. 1B, front surface 104 includes antennas 12*a* through 12*p*, 14*a* through 14*p*, 16*a* through 16*p*, and 18*a* through 18*p*, collectively referred to as antennas 12-18. In one implementation, antennas 12-18 may be configured to receive and/or transmit signals from and/or to one or more commercial geostationary communication satellites or low earth orbit satellites.

In one implementation, for a wireless transmitter transmitting signals at 10 GHz (i.e., $\lambda$=30 mm), each antenna needs an area of at least a quarter wavelength (i.e., $\lambda/4$=7.5 mm) by a quarter wavelength (i.e., $\lambda/4$=7.5 mm) to receive the transmitted signals. As illustrated in FIG. 1B, antennas 12-18 in front surface 104 may each have a square shape having dimensions of 7.5 mm by 7.5 mm, for example. In one implementation, each adjacent pair of antennas 12-18 may be separated by a distance of a multiple integer of the quarter wavelength (i.e., $n*\lambda/4$), such as 7.5 mm, 15 mm, 22.5 mm and etc. In general, the performance of the phased array antenna panel improves with the number of antennas 12-18 on front surface 104.

In the present implementation, the phased array antenna panel is a flat panel array employing antennas 12-18, where antennas 12-18 are coupled to associated active circuits to form a beam for reception (or transmission). In one implementation, the beam is formed fully electronically by means of phase control devices associated with antennas 12-18. Thus, phased array antenna panel 100 can provide fully electronic beamforming without the use of mechanical parts.

As illustrated in FIG. 1B, RF front end chips 106*a* through 106*p*, and antennas 12*a* through 12*p*, 14*a* through 14*p*, 16*a* through 16*p*, and 18*a* through 18*p*, are divided into respective antenna segments 111, 113, 115, and 117. As further illustrated in FIG. 1B, antenna segment 111 includes front end unit 105*a* having RF front end chip 106*a* coupled to antennas 12*a*, 14*a*, 16*a*, and 18*a*, front end unit 105*b* having RF front end chip 106*b* coupled to antennas 12*b*, 14*b*, 16*b*, and 18*b*, front end unit 105*c* having RF front end chip 106*c* coupled to antennas 12*c*, 14*c*, 16*c*, and 18*c*, and front end unit 105*d* having RF front end chip 106*d* coupled to antennas 12*d*, 14*d*, 16*d*, and 18*d*. Antenna segment 113 includes similar front end units having RF front end chip 106*e* coupled to antennas 12*e*, 14*e*, 16*e*, and 18*e*, RF front end chip 106*f* coupled to antennas 12*f*, 14*f*, 16*f*, and 18*f*, RF front end chip 106*g* coupled to antennas 12*g*, 14*g*, 16*g*, and 18*g*, and RF front end chip 106*h* coupled to antennas 12*h*, 14*h*, 16*h*, and 18*h*. Antenna segment 115 also includes similar front end units having RF front end chip 106*i* coupled to antennas 12*i*, 14*i*, 16*i*, and 18*i*, RF front end chip 106*j* coupled to antennas 12*j*, 14*j*, 16*j*, and 18*j*, RF front end chip 106*k* coupled to antennas 12*k*, 14*k*, 16*k*, and 18*k*, and RF front end chip 106*l* coupled to antennas 12*l*, 14*l*, 16*l*, and 18*l*. Antenna segment 117 also includes similar front end units having RF front end chip 106*m* coupled to antennas 12*m*, 14*m*, 16*m*, and 18*m*, RF front end chip 106*n* coupled to antennas 12*n*, 14*n*, 16*n*, and 18*n*, RF front end chip 106*o* coupled to antennas 12*o*, 14*o*, 16*o*, and 18*o*, and RF front end chip 106*p* coupled to antennas 12*p*, 14*p*, 16*p*, and 18*p*.

As illustrated in FIG. 1B, master chip 108 is configured to drive in parallel control buses 110*a*, 110*b*, 110*c*, and 110*d* coupled to antenna segments 111, 113, 115, and 117, respectively. For example, control bus 110*a* is coupled to RF front end chips 106*a*, 106*b*, 106*c*, and 106*d* in antenna segment 111 to provide phase shift signals and amplitude control signals to the corresponding antennas coupled to each of RF front end chips 106*a*, 106*b*, 106*c*, and 106*d*. Control buses 110*b*, 110*c*, and 110*d* are configured to perform similar functions as control bus 110*a*. In the present implementation, master chip 180 and antenna segments 111, 113, 115, and 117 having RF front end chips 106*a* through 106*p* and antennas 12-18 are all integrated on a single printed circuit board.

It should be understood that layout diagram 190 in FIG. 1B is intended to show a simplified phased array antenna panel according to the present inventive concepts. In one implementation, master chip 180 may be configured to control a total of 2000 antennas disposed in ten antenna segments. In this implementation, master chip 180 may be configured to drive in parallel ten control buses, where each control bus is coupled to a respective antenna segment, where each antenna segment has a set of 50 RF front end chips and a group of 200 antennas are in each antenna segment; thus, each RF front end chip is coupled to four antennas. Even though this implementation describes each RF front end chip coupled to four antennas, this implementation is merely an example. An RF front end chip may be coupled to any number of antennas, particularly a number of antennas ranging from three to sixteen.

Figure 2:
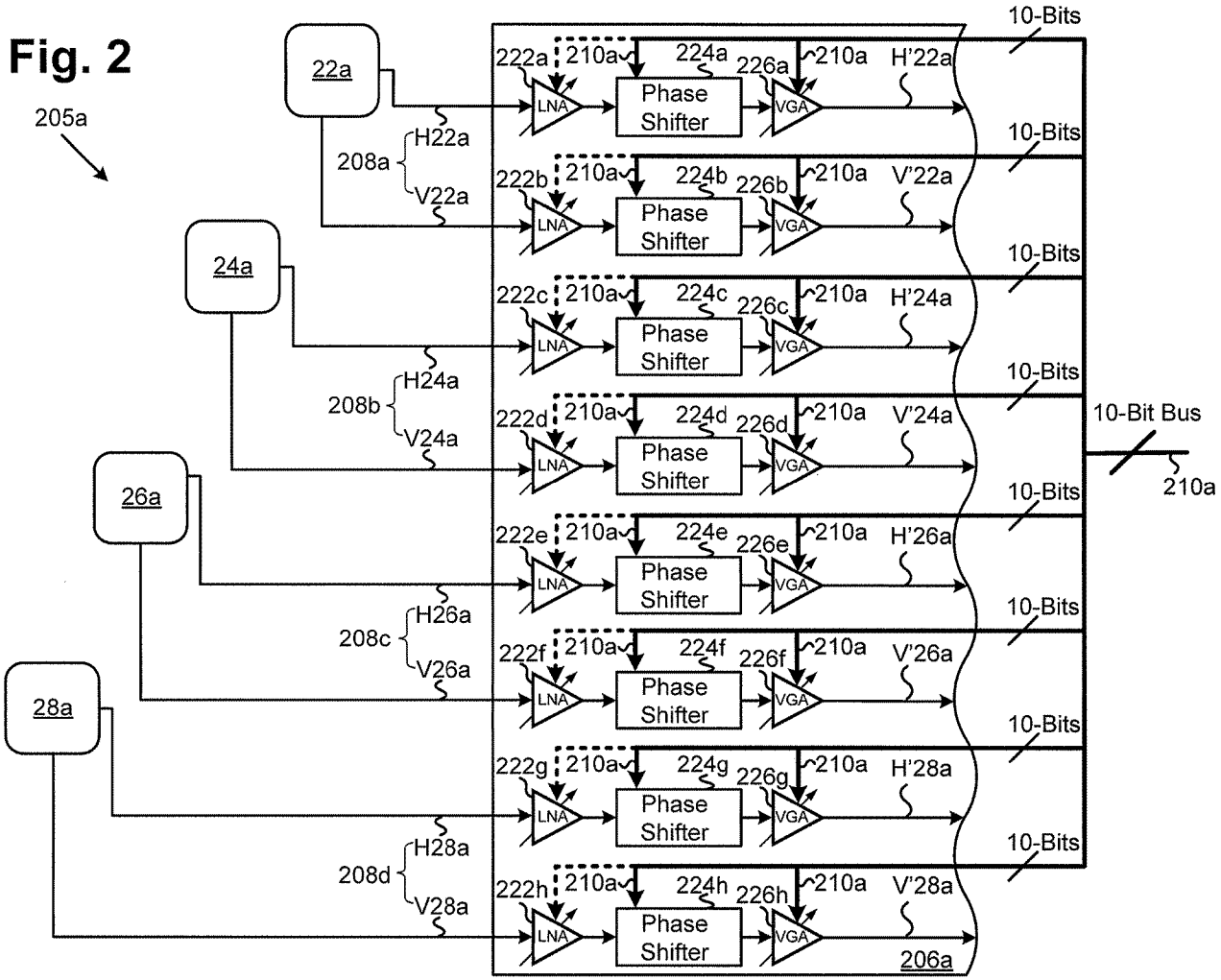
FIG. 2 illustrates a functional block diagram of a portion of an exemplary phased array antenna panel according to one implementation of the present application.

FIG. 2 illustrates a functional block diagram of a portion of an exemplary phased array antenna panel according to one implementation of the present application. In the present implementation, front end unit 205*a* may correspond to front end unit 105*a* in FIG. 1B of the present application. As illustrated in FIG. 2, front end unit 205*a* includes antennas 22*a*, 24*a*, 26*a*, and 28*a* coupled to RF front end chip 206*a*, where antennas 22*a*, 24*a*, 26*a*, and 28*a* and RF front end chip 206*a* may correspond to antennas 12*a*, 14*a*, 16*a*, and 18*a* and RF front end chip 106*a*, respectively, in FIG. 1B.

In the present implementation, antennas 22*a*, 24*a*, 26*a*, and 28*a* may be configured to receive signals from one or more commercial geostationary communication satellites, for example, which typically employ circularly polarized or linearly polarized signals defined at the satellite with a horizontally-polarized (H) signal having its electric-field oriented parallel with the equatorial plane and a vertically-polarized (V) signal having its electric-field oriented perpendicular to the equatorial plane. As illustrated in FIG. 2, each of antennas 22*a*, 24*a*, 26*a*, and 28*a* is configured to provide an H output and a V output to RF front end chip 206*a*.

For example, antenna 22*a* provides linearly polarized signal 208*a*, having horizontally-polarized signal H22*a* and vertically-polarized signal V22*a*, to RF front end chip 206*a*. Antenna 24*a* provides linearly polarized signal 208*b*, having horizontally-polarized signal H24*a* and vertically-polarized signal V24*a*, to RF front end chip 206*a*. Antenna 26*a* provides linearly polarized signal 208*c*, having horizontally-polarized signal H26*a* and vertically-polarized signal V26*a*, to RF front end chip 206*a*. Antenna 28*a* provides linearly polarized signal 208*d*, having horizontally-polarized signal H28*a* and vertically-polarized signal V28*a*, to RF front end chip 206*a*.

As illustrated in FIG. 2, horizontally-polarized signal H22*a* from antenna 22*a* is provided to a receiving circuit having low noise amplifier (LNA) 222*a*, phase shifter 224*a* and variable gain amplifier (VGA) 226*a*, where LNA 222*a* is configured to generate an output to phase shifter 224*a*, and phase shifter 224*a* is configured to generate an output to VGA 226*a*. In addition, vertically-polarized signal V22*a* from antenna 22*a* is provided to a receiving circuit including low noise amplifier (LNA) 222*b*, phase shifter 224*b* and variable gain amplifier (VGA) 226*b*, where LNA 222*b* is configured to generate an output to phase shifter 224*b*, and phase shifter 224*b* is configured to generate an output to VGA 226*b*.

As shown in FIG. 2, horizontally-polarized signal H24*a* from antenna 24*a* is provided to a receiving circuit having low noise amplifier (LNA) 222*c*, phase shifter 224*c* and variable gain amplifier (VGA) 226*c*, where LNA 222*c* is configured to generate an output to phase shifter 224*c*, and phase shifter 224*c* is configured to generate an output to VGA 226*c*. In addition, vertically-polarized signal V24*a* from antenna 24*a* is provided to a receiving circuit including low noise amplifier (LNA) 222*d*, phase shifter 224*d* and variable gain amplifier (VGA) 226*d*, where LNA 222*d* is configured to generate an output to phase shifter 224*d*, and phase shifter 224*d* is configured to generate an output to VGA 226*d*.

As illustrated in FIG. 2, horizontally-polarized signal H26*a* from antenna 26*a* is provided to a receiving circuit having low noise amplifier (LNA) 222*e*, phase shifter 224*e* and variable gain amplifier (VGA) 226*e*, where LNA 222*e* is configured to generate an output to phase shifter 224*e*, and phase shifter 224*e* is configured to generate an output to VGA 226*e*. In addition, vertically-polarized signal V26*a* from antenna 26*a* is provided to a receiving circuit including low noise amplifier (LNA) 222*f*, phase shifter 224*f* and variable gain amplifier (VGA) 226*f*, where LNA 222*f* is configured to generate an output to phase shifter 224*f*, and phase shifter 224*f* is configured to generate an output to VGA 226*f*.

As further shown in FIG. 2, horizontally-polarized signal H28*a* from antenna 28*a* is provided to a receiving circuit having low noise amplifier (LNA) 222*g*, phase shifter 224*g* and variable gain amplifier (VGA) 226*g*, where LNA 222*g* is configured to generate an output to phase shifter 224*g*, and phase shifter 224*g* is configured to generate an output to VGA 226*g*. In addition, vertically-polarized signal V28*a* from antenna 28*a* is provided to a receiving circuit including low noise amplifier (LNA) 222*h*, phase shifter 224*h* and variable gain amplifier (VGA) 226*h*, where LNA 222*h* is configured to generate an output to phase shifter 224*h*, and phase shifter 224*h* is configured to generate an output to VGA 226*h*.

As further illustrated in FIG. 2, control bus 210*a*, which may correspond to control bus 110*a* in FIG. 1B, is provided to RF front end chip 206*a*, where control bus 210*a* is configured to provide phase shift signals to phase shifters 224*a*, 224*b*, 224*c*, 224*d*, 224*e*, 224*f*, 224*g*, and 224*h* in RF front end chip 206*a* to cause a phase shift in at least one of these phase shifters, and to provide amplitude control signals to VGAs 226*a*, 226*b*, 226*c*, 226*d*, 226*e*, 226*f*, 226*g*, and 226*h*, and optionally to LNAs 222*a*, 222*b*, 222*c*, 222*d*, 222*e*, 222*f*, 222*g*, and 222*h* in RF front end chip 206*a* to cause an amplitude change in at least one of the linearly polarized signals received from antennas 22*a*, 24*a*, 26*a*, and 28*a*. It should be noted that control bus 210*a* is also provided to other front end units, such as front end units 105*b*, 105*c*, and 105*d* in segment 111 of FIG. 1B. In one implementation, at least one of the phase shift signals carried by control bus 210*a* is configured to cause a phase shift in at least one linearly polarized signal, e.g., horizontally-polarized signals H22*a* through H28*a* and vertically-polarized signals V22*a* through V28*a*, received from a corresponding antenna, e.g., antennas 22*a*, 24*a*, 26*a*, and 28*a*.

In one implementation, amplified and phase shifted horizontally-polarized signals H'22*a*, H'24*a*, H'26*a*, and H'28*a* in front end unit 205*a*, and other amplified and phase shifted horizontally-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide an H-combined output to a master chip such as master chip 180 in FIG. 1. Similarly, amplified and phase shifted vertically-polarized signals V'22*a*, V'24*a*, V'26*a*, and V'28*a* in front end unit 205*a*, and other amplified and phase shifted vertically-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide a V-combined output to a master chip such as master chip 180 in FIG. 1.

Figure 3A:
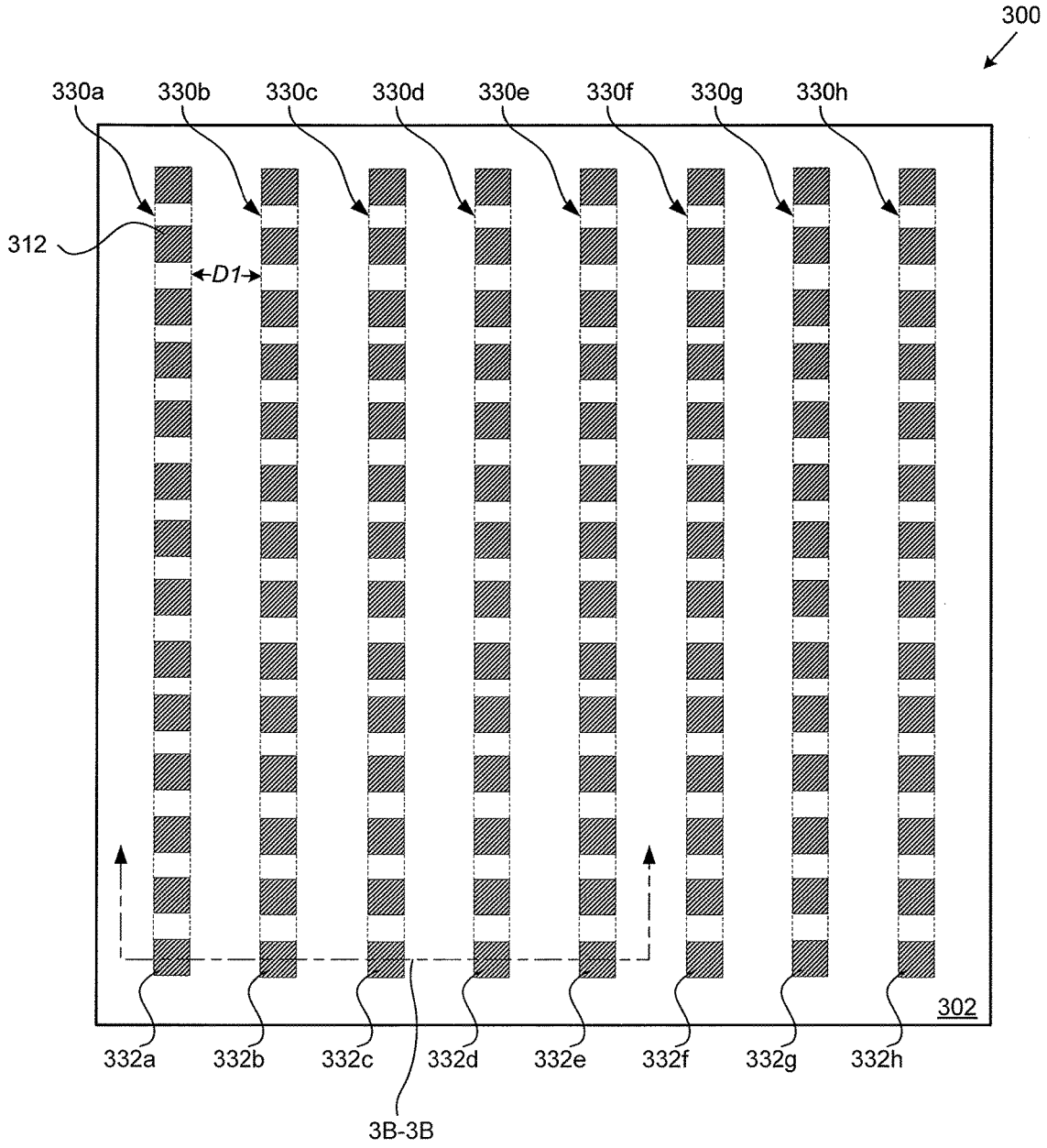
FIG. 3A illustrates a top view of a portion of an exemplary phased array antenna panel according to one implementation of the present application.

FIG. 3A illustrates a top view of a portion of an exemplary phased array antenna panel according to one implementation of the present application. As illustrated in FIG. 3A, exemplary phased array antenna panel 300 includes substrate 302, antennas 312, antenna rows 330*a*, 330*b*, 330*c*, 330*d*, 330*e*, 330*f*, 330*g*, and 330*h*, collectively referred to as antenna rows 330, and row-end antennas 332*a*, 332*b*, 332*c*, 332*d*, 332*e*, 332*f*, 332*g*, and 332*h*, collectively referred to as row-end antennas 332. Some features discussed in conjunction with the layout diagram of FIG. 1B, such as a master chip, control and data buses, and RF front end chips, are omitted in FIG. 3A for the purposes of clarity.

As illustrated in FIG. 3A, antennas 312 may be arranged on the top surface of substrate 302 in antenna rows 330. In one implementation, the distance between one antenna and an adjacent antenna in each one of antenna rows 330 is a fixed distance, such as a quarter wavelength (i.e., λ/4). As illustrated in FIG. 3A, antenna rows 330 are rows of fourteen antennas 312. In other implementations, antenna rows 330 may be rows of twelve antennas, or rows of sixteen antennas, or any other number of antennas. Multiple antenna rows 330 may be arranged on substrate 302 of phased array antenna panel 300. In one implementation, the distance between adjacent antenna rows is a fixed distance. As illustrated in FIG. 3A, a fixed distance D1 separates antenna row 330*a* from adjacent antenna row 330*b*, with no antennas therebetween. In one implementation, distance D1 may be greater than a quarter wavelength (i.e., greater than 214).

Figure 3B:
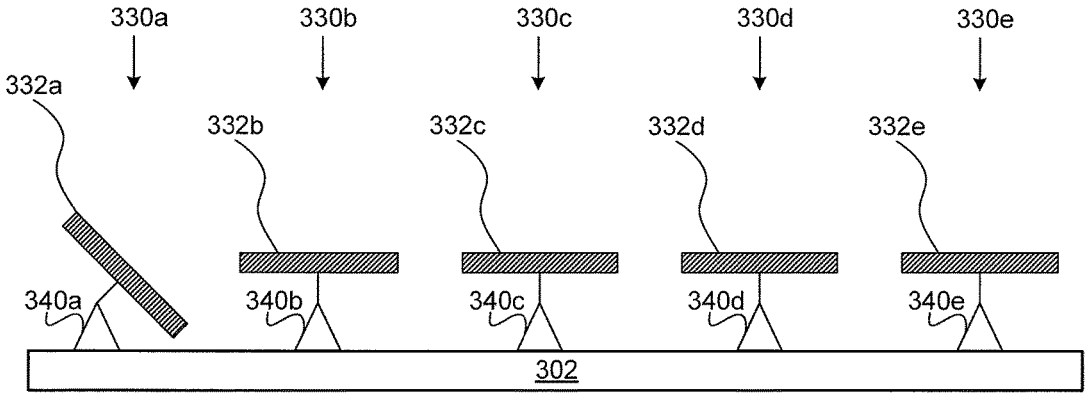
FIG. 3B illustrates a cross-sectional view of a portion of an exemplary phased array antenna panel according to one implementation of the present application.

FIG. 3B illustrates a cross-sectional view of a portion of phased array antenna panel 300, corresponding to cross-section 3B-3B shown in FIG. 3A. As illustrated in FIG. 3B, antenna rows 330*a*, 330*b*, 330*c*, 330*d*, and 330*e* have respective row-end antennas 332*a*, 332*b*, 332*c*, 332*d*, and 332*e* attached respectively to slanting mechanisms 340*a*, 340*b*, 340*c*, 340*d*, and 340*e*, collectively referred to as slanting mechanisms 340. Slanting mechanisms 340 may be actuators. In one implementation, slanting mechanisms 340 may be millimeter-scale piezo-actuators, such as prefabricated tip/tilt piezo-actuators having diameters of, for example, 6.4 millimeters and heights of 8.3 millimeters. Alternatively, by way of other examples, prefabricated stack piezo-actuators having dimensions of, for example, 2 millimeters by 3 millimeters by 5 millimeters (2 mm×3 mm×5 mm), in addition to other custom piezo-actuators can be used. In another implementation, slanting mechanisms 340 may be microelectromechanical systems (MEMS) actuators, such as electrostatic torsion plate or thermal torsion plate actuators. As illustrated in FIG. 3B, slanting mechanism 340*a* may cause antenna row 330*a* to be slanted to a desired angle based on signals received from a master chip (not shown in FIG. 3B). In the example provided by FIG. 3B, antenna row 330*a* has been slanted by slanting mechanism 340*a*. However, the cross-sectional view provided by FIG. 3B shows only slanted row-end antenna 332*a* of antenna row 330*a*, while the remaining antennas in antenna row 330*a* are directly behind row-end antenna 332*a* and thus cannot be seen in the cross-sectional view provided by FIG. 3B.

The intended or desired angle of the slanted antenna row shown in FIG. 3B may be exaggerated for the purposes of illustration. In one implementation, slanting mechanism 340*a* may cause antenna row 330*a* to be slanted to a desired angle utilizing one actuator for the entire row 330*a*. In another implementation, slanting mechanism 340*a* may cause antenna row 330*a* to be slanted to a desired angle utilizing one actuator for each antenna in row 330*a*. In one implementation, individual antennas in row 330*a* can be slanted to a desired angle that may be a different angle from angles to which other antennas in row 330*a* are slanted.

Slanting mechanism 340*a* may be attached to substrate 302. A master chip (not shown in FIG. 3B) may be configured to control the operation of slanting mechanism 340*a* by signals sent through traces, conductors, and/or vias in substrate 302. For example, a master chip may control timing, direction, desired angle, and speed of slanting mechanism 340*a*. By causing an antenna row of phased array antenna panel 300 to be slanted in a desired angle, phased array antenna panel 300 can change the direction of an RF beam formed by phased array antenna panel 300. Thus, in addition to the improved directionality attributable to the phase and amplitude control capabilities of phased array antenna panel 300, further improvement and control over the directionality of phased array antenna panel 300 can be achieved by causing an antenna row to be slanted to a desired angle.

Figure 4A:
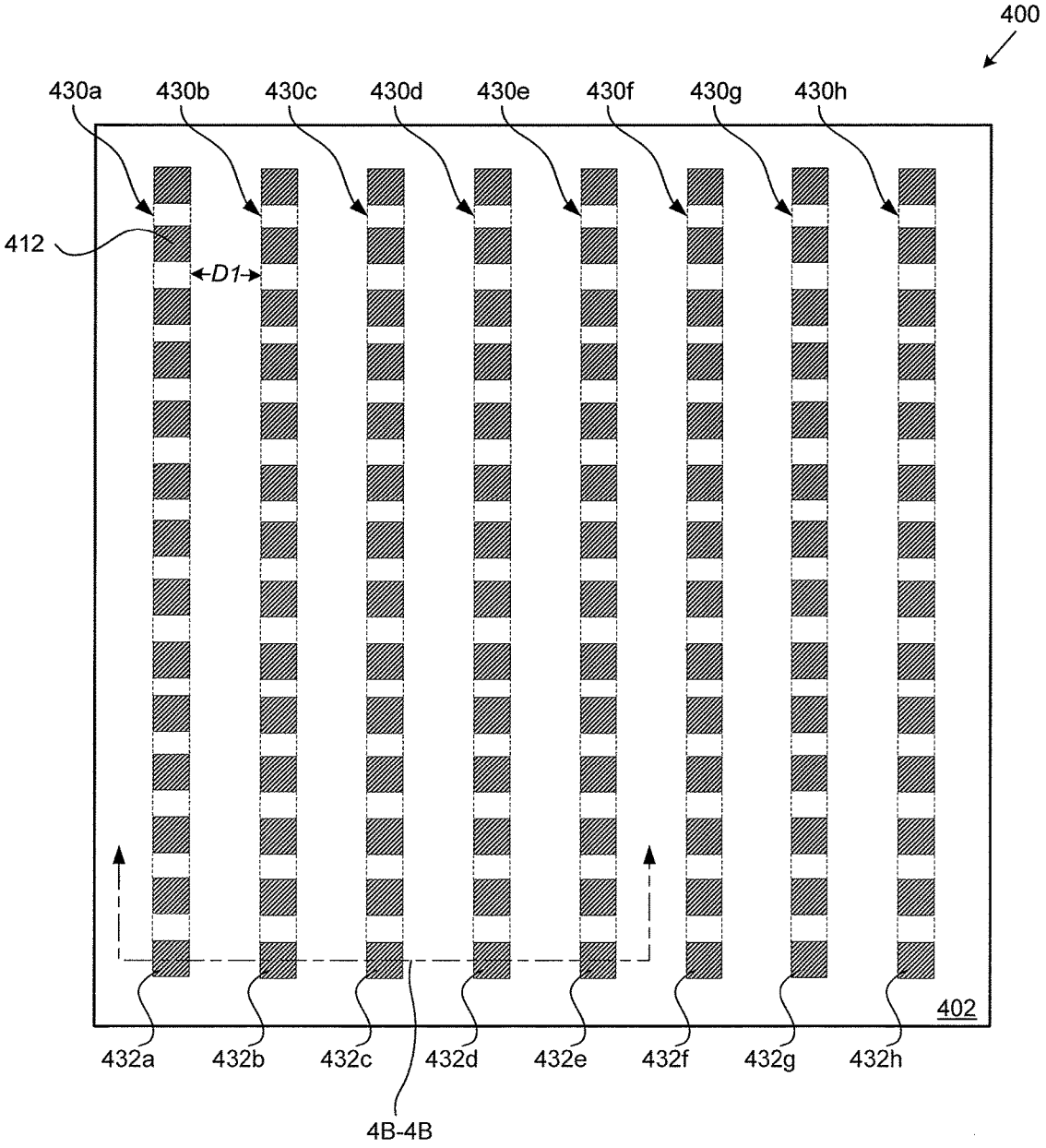
FIG. 4A illustrates a top view of a portion of an exemplary phased array antenna panel according to one implementation of the present application.

FIG. 4A illustrates a top view of a portion of an exemplary phased array antenna panel according to one implementation of the present application. As illustrated in FIG. 4A, exemplary phased array antenna panel 400 includes substrate 402, antennas 412, antenna rows 430*a*, 430*b*, 430*c*, 430*d*, 430*e*, 430*f*, 430*g*, and 430*h*, collectively referred to as antenna rows 430, and row-end antennas 432*a*, 432*b*, 432*c*, 432*d*, 432*e*, 432*f*, 432*g*, and 432*h*, collectively referred to as row-end antennas 432. FIG. 4A represents another implementation of the present application where multiple antenna rows have been slanted, rather than only one row having been slanted—as was the case with respect to FIG. 3A. Phased array antenna panel 400 in FIG. 4A may have any of the configurations described above with respect to FIG. 3A.

Figure 4B:
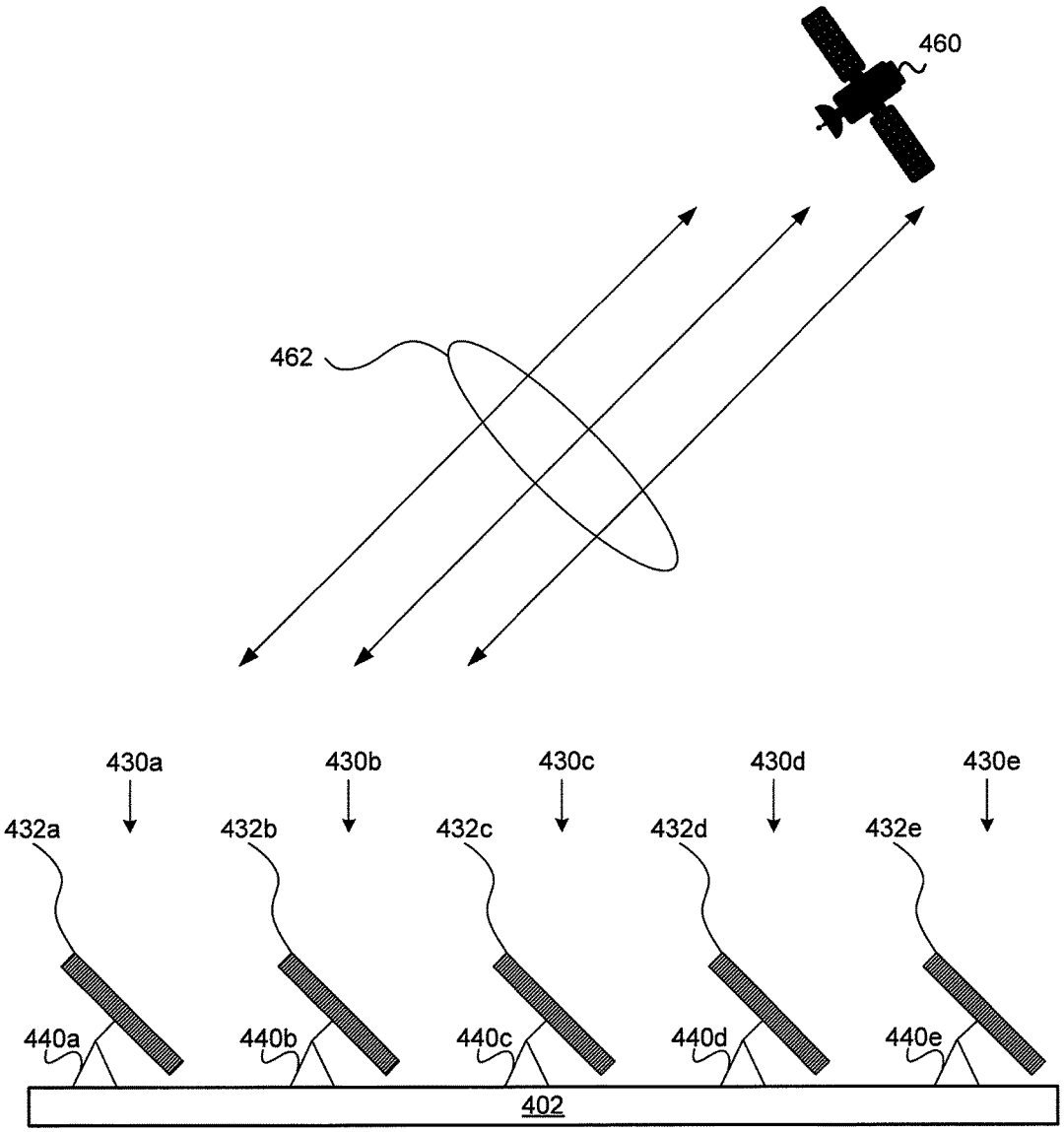
FIG. 4B illustrates a cross-sectional view of a portion of an exemplary phased array antenna panel according to one implementation of the present application.

FIG. 4B illustrates a cross-sectional view of a portion of phased array antenna panel 400, corresponding to cross-section 4B-4B shown in FIG. 4A. As illustrated in FIG. 4B, antenna rows 430*a*, 430*b*, 430*c*, 430*d*, and 430*e* have respective row-end antennas 432*a*, 432*b*, 432*c*, 432*d*, and 432*e*, attached respectively to slanting mechanisms 440*a*, 440*b*, 440*c*, 440*d*, and 440*e*, collectively referred to as slanting mechanisms 440. Slanting mechanisms 440 may be actuators. In one implementation, slanting mechanisms 440 may be millimeter-scale piezo-actuators, such as prefabricated tip/tilt piezo-actuators having diameters of, for example, 6.4 millimeters and heights of 8.3 millimeters. Alternatively, by way of other examples, prefabricated stack piezo-actuators having dimensions of, for example, 2 millimeters by 3 millimeters by 5 millimeters (2 mm×3 mm×5 mm), in addition to other custom piezo-actuators can be used. In another implementation, slanting mechanisms 440 may be microelectromechanical systems (MEMS) actuators, such as electrostatic torsion plate or thermal torsion plate actuators.

In the example provided by FIG. 4B, multiple antenna rows have been slanted by slanting mechanisms 440. Specifically, in FIG. 4B antenna row 430*a* has been slanted by slanting mechanism 440*a*, antenna row 430*b* has been slanted by slanting mechanism 440*b*, antenna row 430*c* has been slanted by slanting mechanism 440*c*, antenna row 430*d* has been slanted by slanting mechanism 440*d*, and antenna row 430*e* has been slanted by slanting mechanism 440*e*. However, the cross-sectional view provided by FIG. 4B shows only slanted row-end antennas 432*a*, 432*b*, 432*c*, 432*d*, and 432*e* of corresponding antenna rows 430*a*, 430*b*, 430*c*, 430*d*, and 430*e*, while the remaining antennas in antenna rows 430*a*, 430*b*, 430*c*, 430*d*, and 430*e* are directly behind row-end antennas 432*a*, 432*b*, 432*c*, 432*d*, and 432*e* and thus cannot be seen in the cross-sectional view provided by FIG. 4B.

The intended or desired angle of the slanted antenna rows shown in FIG. 4B may be exaggerated for the purposes of illustration. In one implementation, each of antenna rows 430 can be slanted to the same desired angle. In another implementation, each of antenna rows 430 can be slanted to a desired angle that may be a different angle from angles to which other antenna rows are slanted. In one implementation, slanting mechanisms 440 may cause antenna rows 430 to be slanted to a desired angle utilizing one actuator for each of antenna rows 430. In another implementation, slanting mechanisms 440 may cause antenna rows 430 to be slanted to a desired angle utilizing one actuator for each antenna in each of antenna rows 430. In one implementation, individual antennas in each of antenna rows 430 can be slanted to a desired angle that may be a different angle from angles to which other antennas in the same row are slanted.

FIG. 4B further illustrates wireless communication system 460 and RF beams 462. As illustrated in FIG. 4B, phased array antenna panel 400 may form RF beams 462. Wireless communication system 460 which may be, for example, a satellite having a transceiver, is in bi-directional communication with phased array antenna panel 400 through RF beams 462. A master chip (not shown in FIG. 4B) may be configured to control the operation of slanting mechanisms 440 at least in part based upon the position of wireless communication system 460 relative to phased array antenna panel 400. In FIG. 4B, antenna rows 430 have been slanted in a desired angle by slanting mechanisms 440, thereby changing the direction of RF beams 462 formed by phased array antenna panel 400, such that the direction of RF beams 462 is substantially perpendicular to antenna rows 430*a*, 430*b*, 430*c*, 430*d*, and 430*e* in phased array antenna panel 400. In other implementations, RF beams 462 may have any other direction relative to antenna rows 430*a*, 430*b*, 430*c*, 430*d*, and 430*e*. In one implementation, wireless communication system 460 may be a transmitter and phased array antenna panel 400 may be a receiver. In another implementation, wireless communication system 460 may be a receiver and phased array antenna panel 400 may be a transmitter.

Figure 5A:
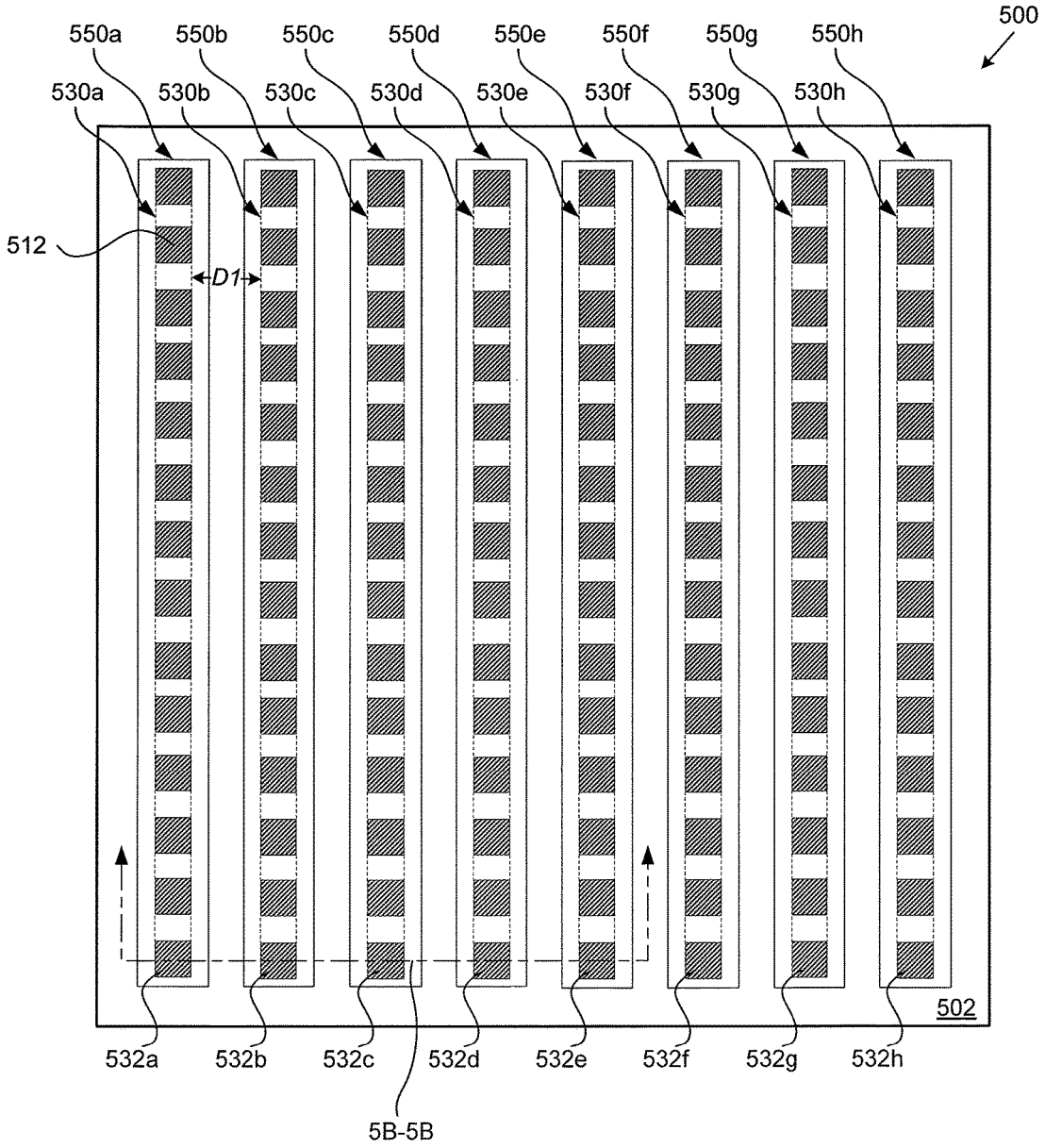
FIG. 5A illustrates a top view of a portion of an exemplary lens-enhanced phased array antenna panel according to one implementation of the present application.

FIG. 5A illustrates a top view of a portion of an exemplary phased array antenna panel according to one implementation of the present application. As illustrated in FIG. 5A, exemplary phased array antenna panel 500 includes substrate 502, antennas 512, antenna rows 530*a*, 530*b*, 530*c*, 530*d*, 530*e*, 530*f*, 530*g*, and 530*h*, collectively referred to as antenna rows 530, row-end antennas 532*a*, 532*b*, 532*c*, 532*d*, 532*e*, 532*f*, 532*g*, and 532*h*, and lenses 550*a*, 550*b*, 550*c*, 550*d*, 550*e*, 550*f*, 550*g*, and 550*h*, collectively referred to as lenses 550.

Phased array antenna panel 500 in FIG. 5A may have any of the configurations described above, however, in the example provided by FIG. 5A, lenses 550 are situated over phased array antenna panel 500. In FIG. 5A, phased array antenna panel 500 is seen through lenses 550. As further shown in FIG. 5A, lenses 550 are narrow, elongated, and used with antenna rows 530. Thus, lenses 550 are referred to as row-shaped lenses in the present application. In some implementations of the present application, one lens may correspond to more than one antenna row (i.e. one lens can be wide enough to cover two or more antenna rows), and conversely not all antenna rows must have a corresponding lens (i.e. some antenna rows may have no corresponding lens situated thereon). Row-shaped lenses 550 may be dielectric lenses, e.g., made of polystyrene or Lucite® and polyethylene. In other implementations, row-shaped lenses 550 may be Fresnel zone plate lenses, or a metallic waveguide lenses. In yet other implementations, row-shaped lenses 550 may be flat (or substantially flat) lenses that include perforations, such as slots or holes. Row-shaped lenses 550 may be separate lenses, each individually placed over phased array antenna panel 500. Alternatively, row-shaped lenses 550 may be placed over phased array antenna panel 500 as a lens array, where one substrate holds together multiple lenses 550.

Row-shaped lenses 550 may increase gains of their corresponding antenna rows 530 in phased array antenna panel 500 by focusing an incoming RF beam onto their corresponding antenna rows 530. A master chip (not shown in FIG. 5A) may be configured to control the operation of antenna rows 530, and to receive a combined output, as stated above. Thus, by increasing the gain of each one of, or selected ones of, antenna rows 530, the total gain of the phased array antenna panel 500 is increased, resulting in an increase in the power of RF signals being processed by the phased array antenna panel 500, without increasing the area of the phased array antenna panel or the number of antennas therein.

Figure 5B:
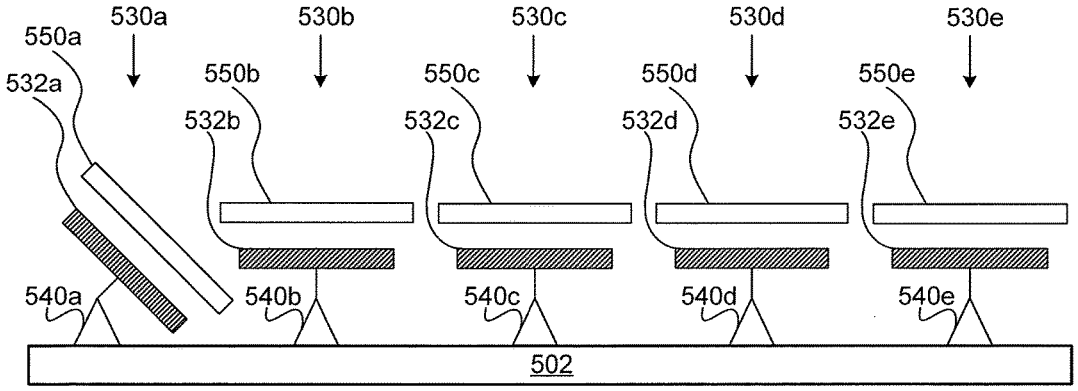
FIG. 5B illustrates a cross-sectional view of a portion of an exemplary lens-enhanced phased array antenna panel according to one implementation of the present application.

FIG. 5B illustrates a cross-sectional view of a portion of phased array antenna panel 500, corresponding to cross-section 5B-5B shown in FIG. 5A. As illustrated in FIG. 5B, lenses 550*a*, 550*b*, 550*c*, 550*d*, and 550*e* are situated respectively over corresponding antenna rows 530*a*, 530*b*, 530*c*, 530*d*, and 530*e*. Antenna rows 530*a*, 530*b*, 530*c*, 530*d*, and 530*e* have respective row-end antennas 532*a*, 532*b*, 532*c*, 532*d*, and 532*e* attached respectively to slanting mechanisms 540*a*, 540*b*, 540*c*, 540*d*, and 540*e*, collectively referred to as slanting mechanisms 540. Slanting mechanisms 540 may be actuators. In one implementation, slanting mechanisms 540 may be millimeter-scale piezo-actuators, such as prefabricated tip/tilt piezo-actuators having diameters of, for example, 6.4 millimeters and heights of 8.3 millimeters. Alternatively, by way of other examples, prefabricated stack piezo-actuators having dimensions of, for example, 2 millimeters by 3 millimeters by 5 millimeters (2 mm×3 mm×5 mm), in addition to other custom piezo-actuators can be used. In another implementation, slanting mechanisms 540 may be microelectromechanical systems (MEMS) actuators, such as electrostatic torsion plate or thermal torsion plate actuators. As illustrated in FIG. 5B, slanting mechanism 540*a* may cause antenna row 530*a* to be slanted to a desired angle based on signals received from a master chip (not shown in FIG. 5B). In the example provided by FIG. 5B, antenna row 530*a* has been slanted by slanting mechanism 540*a*. However, the cross-sectional view provided by FIG. 5B shows only slanted row-end antenna 532*a* of antenna row 530*a*, while the remaining antennas in antenna row 530*a* are directly behind row-end antenna 532*a* and thus cannot be seen in the cross-sectional view provided by FIG. 5B.

The intended or desired angle of the slanted antenna row shown in FIG. 5B may be exaggerated for the purposes of illustration. In one implementation, slanting mechanism 540*a* may cause antenna row 530*a* to be slanted to a desired angle utilizing one actuator for the entire row 530*a*. In another implementation, slanting mechanism 540*a* may cause antenna row 530*a* to be slanted to a desired angle utilizing one actuator for each antenna in row 530*a*. In one implementation, individual antennas in row 530*a* can be slanted to a desired angle that may be a different angle from angles to which other antennas in row 530*a* are slanted.

In the example provided by FIG. 5B, row-shaped lens 550*a* has been slanted to a desired angle. Various connections and components related to row-shaped lens 550*a* are omitted in FIG. 5B for the purposes of clarity. In one implementation, row-shaped lens 550*a* may be controlled by slanting mechanism 540*a*, such that slanting mechanism 540*a* may cause both antenna row 530*a* and row-shaped lens 550*a* to be slanted to a desired angle based on signals received from a master chip (not shown in FIG. 5B). In another implementation, row-shaped lens 550*a* may be controlled by another slanting mechanism that is distinct from slanting mechanisms 540. For example, row-shaped lens 550*a* may be attached to a plurality of stack piezo-actuators that are situated adjacent to antennas in antenna row 530*a* and attached to substrate 502. In yet another implementation, row-shaped lens 550*a* may be mounted on antennas in antenna row 530*a*, such that slanting the antennas in antenna row 530*a* may cause row-shaped lens 550*a* to be slanted to a desired angle.

The intended or desired angle of the slanted row-shaped lens shown in FIG. 5B may be exaggerated for the purposes of illustration. In one implementation, row-shaped lens 550*a* can be maintained substantially parallel with antenna row 530*a*, and thus be slanted to substantially the same angle as antenna row 530*a*. In one implementation, row-shaped lens 550*a* can be slanted to a desired angle that may be a different angle from an angle to which antenna row 530*a* is slanted. In one implementation, multiple lenses can be situated over antenna row 530*a*, and individual lenses can be slanted to a desired angle that may be a different angle from angles to which other lenses over antenna row 530*a* are slanted.

A master chip (not shown in FIG. 5B) may be configured to control the slanting of row-shaped lens 550*a* by signals sent through traces, conductors, and/or vias in substrate 502. For example, a master chip may control timing, direction, desired angle, and speed of the mechanisms that cause row-shaped lens 550*a* to be slanted. By causing a row-shaped lens and a corresponding antenna row of phased array antenna panel 500 to be slanted in a desired angle, phased array antenna panel 500 can change the direction of an RF beam formed by phased array antenna panel 500, while also increasing a total gain of phased array antenna panel 500. Thus, in addition to the improved directionality attributable to the phase and amplitude control capabilities of phased array antenna panel 500, further improvement and control over the directionality of phased array antenna panel 500 can be achieved by causing a row-shaped lens and a corresponding antenna row to be slanted to a desired angle.

Figure 6A:
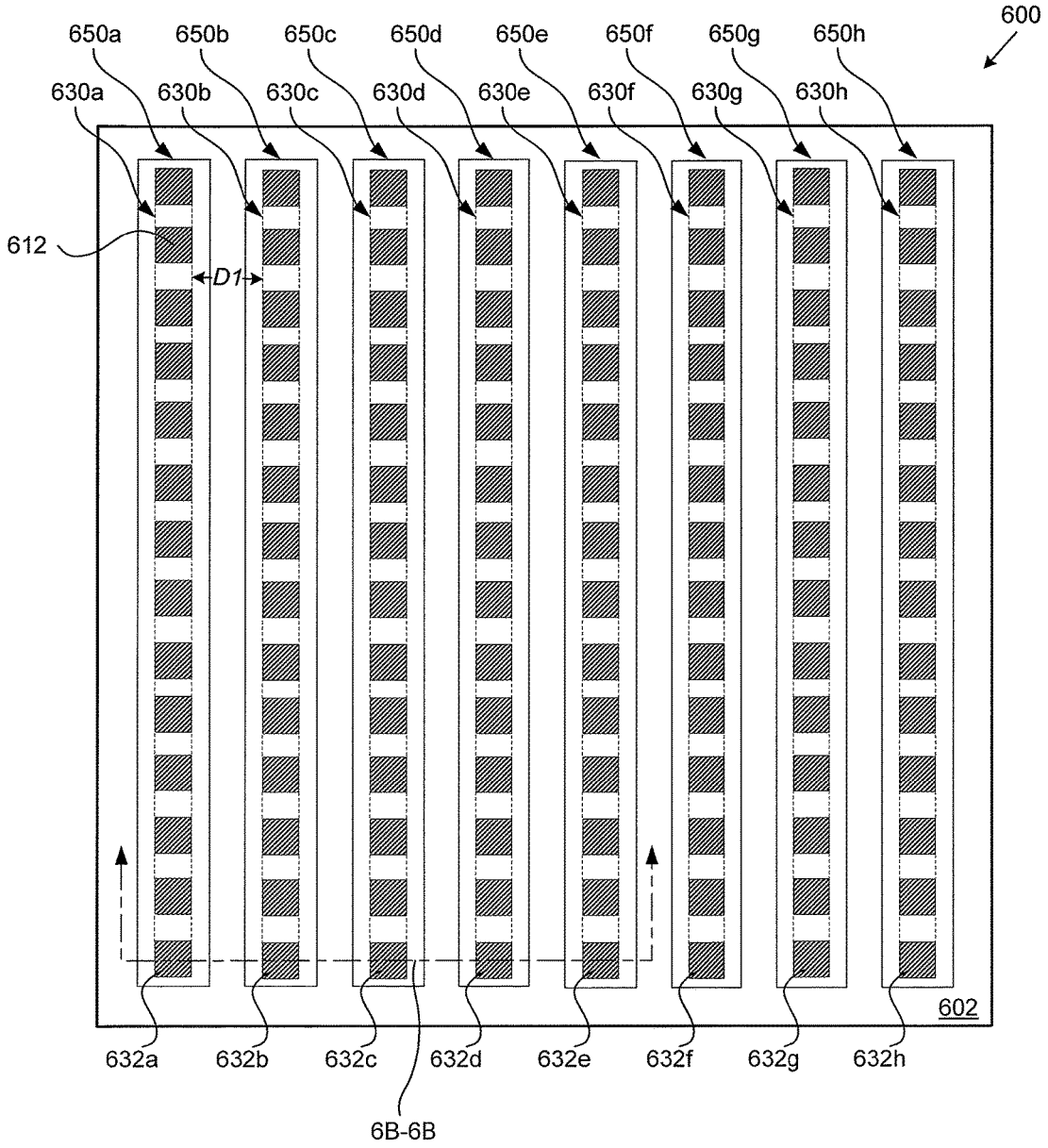
FIG. 6A illustrates a top view of a portion of an exemplary lens-enhanced phased array antenna panel according to one implementation of the present application.

FIG. 6A illustrates a top view of a portion of an exemplary phased array antenna panel according to one implementation of the present application. As illustrated in FIG. 6A, exemplary phased array antenna panel 600 includes substrate 602, antennas 612, antenna rows 630*a*, 630*b*, 630*c*, 630*d*, 630*e*, 630*f*, 630*g*, and 630*h*, collectively referred to as antenna rows 630, row-end antennas 632*a*, 632*b*, 632*c*, 632*d*, 632*e*, 632*f*, 632*g*, and 632*h*, collectively referred to as row-end antennas 632, and row-shaped lenses 650*a*, 650*b*, 650*c*, 650*d*, 650*e*, 650*f*, 650*g*, and 650*h*, collectively referred to as row-shaped lenses 650. FIG. 6A represents another implementation of the present application where multiple row-shaped lenses have been slanted, rather than only one row-shaped lens having been slanted—as was the case with respect to FIG. 5A. Phased array antenna panel 600 in FIG. 6A may have any of the configurations described above with respect to FIG. 5A.

Figure 6B:
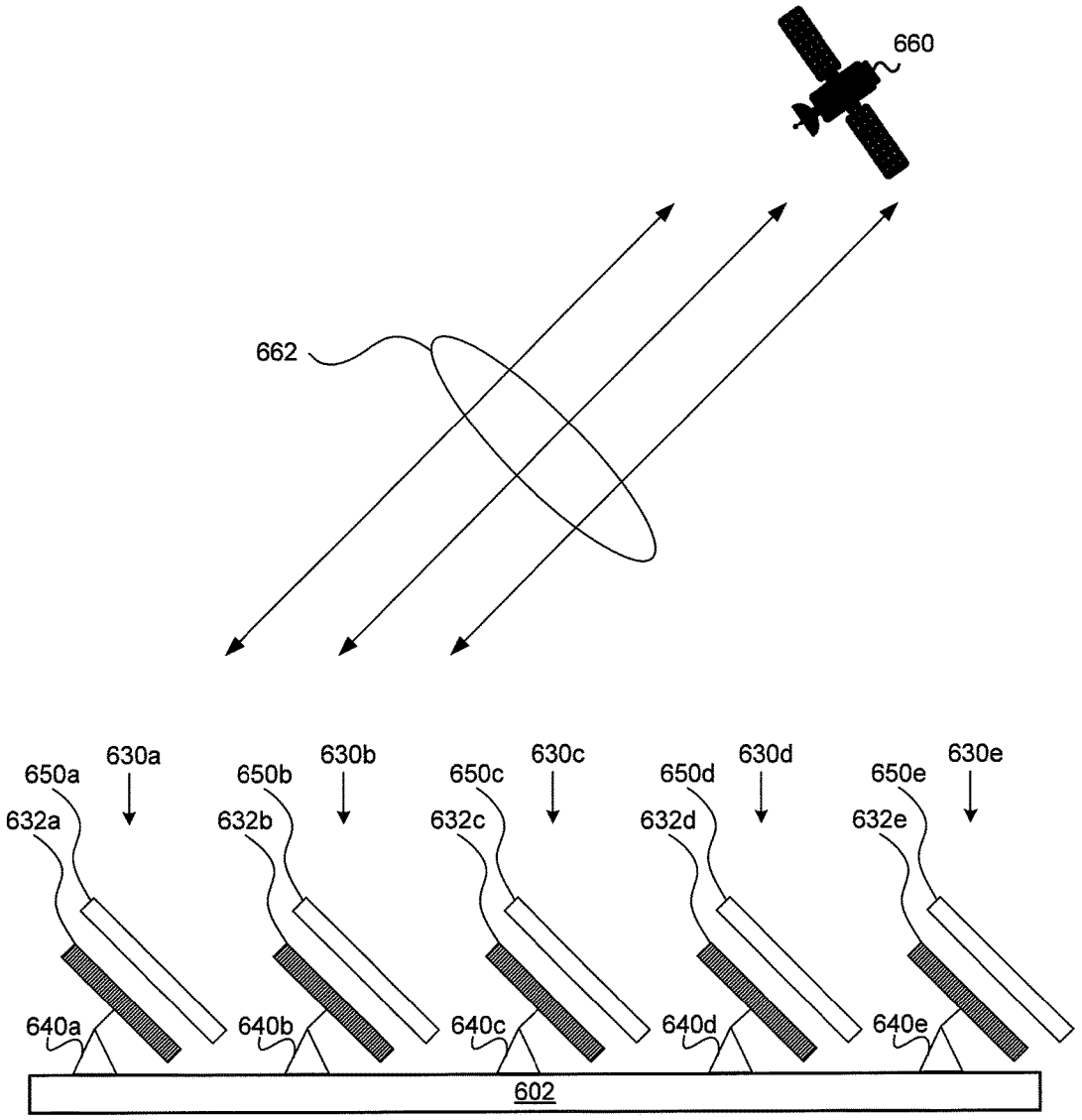
FIG. 6B illustrates a cross-sectional view of a portion of an exemplary lens-enhanced phased array antenna panel according to one implementation of the present application.

FIG. 6B illustrates a cross-sectional view of a portion of phased array antenna panel 600, corresponding to cross-section 6B-6B shown in FIG. 6A. As illustrated in FIG. 6B, lenses 650*a*, 650*b*, 650*c*, 650*d*, and 650*e* are situated respectively over corresponding antenna rows 630*a*, 630*b*, 630*c*, 630*d*, and 630*e*. Antenna rows 630*a*, 630*b*, 630*c*, 630*d*, and 630*e* have respective row-end antennas 632*a*, 632*b*, 632*c*, 632*d*, and 632*e* attached respectively to slanting mechanisms 640*a*, 640*b*, 640*c*, 640*d*, and 640*e*, collectively referred to as slanting mechanisms 640. Slanting mechanisms 640 may be actuators. In one implementation, slanting mechanisms 640 may be millimeter-scale piezo-actuators, such as prefabricated tip/tilt piezo-actuators having diameters of, for example, 6.4 millimeters and heights of 8.3 millimeters. Alternatively, by way of other examples, prefabricated stack piezo-actuators having dimensions of, for example, 2 millimeters by 3 millimeters by 5 millimeters (2 mm×3 mm×5 mm), in addition to other custom piezo-actuators can be used. In another implementation, slanting mechanisms 640 may be microelectromechanical systems (MEMS) actuators, such as electrostatic torsion plate or thermal torsion plate actuators.

In the example provided by FIG. 6B, multiple antenna rows have been slanted by slanting mechanisms 640. Specifically, in FIG. 6B antenna row 630*a* has been slanted by slanting mechanism 640*a*, antenna row 630*b* has been slanted by slanting mechanism 640*b*, antenna row 630*c* has been slanted by slanting mechanism 640*c*, antenna row 630*d* has been slanted by slanting mechanism 640*d*, and antenna row 630*e* has been slanted by slanting mechanism 640*e*. However, the cross-sectional view provided by FIG. 6B shows only slanted row-end antennas 632*a*, 632*b*, 632*c*, 632*d*, and 632*e* of corresponding antenna rows 630*a*, 630*b*, 630*c*, 630*d*, and 630*e*, while the remaining antennas in antenna rows 630*a*, 630*b*, 630*c*, 630*d*, and 630*e* are directly behind row-end antennas 632*a*, 632*b*, 632*c*, 632*d*, and 632*e* and thus cannot be seen in the cross-sectional view provided by FIG. 6B.

The intended or desired angle of the slanted antenna rows shown in FIG. 6B may be exaggerated for the purposes of illustration. In one implementation, each of antenna rows 630 can be slanted to the same desired angle. In another implementation, each of antenna rows 630 can be slanted to a desired angle that may be a different angle from angles to which other antenna rows are slanted. In one implementation, slanting mechanisms 640 may cause antenna rows 630 to be slanted to a desired angle utilizing one actuator for each of antenna rows 630. In another implementation, slanting mechanisms 640 may cause antenna rows 630 to be slanted to a desired angle utilizing one actuator for each antenna in each of antenna rows 630. In one implementation, individual antennas in each of antenna rows 630 can be slanted to a desired angle that may be a different angle from angles to which other antennas in the same row are slanted.

In the example provided by FIG. 6B, multiple row-shaped lenses have been slanted to a desired angle. Specifically, row-shaped lenses 650*a*, 650*b*, 650*c*, 650*d*, and 650*e* have been slanted. Various attachments of row-shaped lenses 650*a*, 650*b*, 650*c*, 650*d*, and 650*e* are omitted in FIG. 6B for the purposes of clarity. In one implementation, row-shaped lenses 650*a*, 650*b*, 650*c*, 650*d*, and 650*e* may be respectively controlled by slanting mechanisms 640*a*, 640*b*, 640*c*, 640*d*, and 640*e*, such that slanting mechanisms 640*a*, 640*b*, 640*c*, 640*d*, and 640*e* may respectively cause antenna rows 630*a*, 630*b*, 630*c*, 630*d*, and 630*e* and corresponding row-shaped lenses 650*a*, 650*b*, 650*c*, 650*d*, and 650*e* to be slanted to a desired angle based on signals received from a master chip (not shown in FIG. 6B). In another implementation, row-shaped lenses 650*a*, 650*b*, 650*c*, 650*d*, and 650*e* may be controlled by other slanting mechanisms that are distinct from slanting mechanisms 640. For example, each of row-shaped lenses 650*a*, 650*b*, 650*c*, 650*d*, and 650*e* may be attached to a plurality of stack piezo-actuators that are arranged around antennas in corresponding antenna rows 630*a*, 630*b*, 630*c*, 630*d*, and 630*e* and attached to substrate 602. In yet another implementation, row-shaped lenses 650*a*, 650*b*, 650*c*, 650*d*, and 650*e* may be respectively mounted on antennas in antenna rows 630*a*, 630*b*, 630*c*, 630*d*, and 630*e*, such that slanting the antennas in antenna rows 630*a*, 630*b*, 630*c*, 630*d*, and 630*e* may respectively cause row-shaped lenses 650*a*, 650*b*, 650*c*, 650*d*, and 650*e* to be slanted to a desired angle.

The intended or desired angle of the slanted row-shaped lenses shown in FIG. 6B may be exaggerated for the purposes of illustration. In one implementation, row-shaped lenses 650 can be maintained substantially parallel with antenna rows 630, and thus be slanted to substantially the same angle as antenna rows 630. In another implementation, each of row-shaped lenses 650 can be slanted to a desired angle that may be a different angle from angles to which other row-shaped lenses are slanted. In one implementation, row-shaped lenses 650 can be slanted to a desired angle that may be a different angle from an angle to which antenna rows 630 are slanted. In one implementation, multiple lenses can be situated over each of antenna rows 630, and individual lenses can be slanted to a desired angle that may be a different angle from angles to which other lenses over the same row are slanted.

FIG. 6B further shows wireless communication system 660 and RF beams 662. As illustrated in FIG. 6B, phased array antenna panel 600 may form RF beams 662. Wireless communication system 660 which may be for example, a satellite having a transceiver, is in bi-directional communication with phased array antenna panel 600 through RF beams 662. A master chip (not shown in FIG. 6B) may be configured to control the operation of slanting mechanisms 640 at least in part based upon the position of wireless communication system 660 relative to phased array antenna panel 600. In FIG. 6B, antenna rows 630 and row-shaped lenses 650 have been slanted in a desired angle by slanting mechanisms 640, thereby changing the direction of RF beams 662 formed by phased array antenna panel 600, such that the direction of RF beams 662 is substantially perpendicular to antenna rows 630*a*, 630*b*, 630*c*, 630*d*, and 630*e* in phased array antenna panel 600. In other implementations, RF beams 662 may have any other direction relative to antenna rows 630*a*, 630*b*, 630*c*, 630*d*, and 630*e*. In one implementation, wireless communication system 660 may be a transmitter and phased array antenna panel 600 may be a receiver. In another implementation, wireless communication system 660 may be a receiver and phased array antenna panel 600 may be a transmitter.

Thus, various implementations of the present application result in an increased directionality of a wireless receiver employing a phased array antenna panel without increasing the number of antennas, phase shifters or front end chips of the phased array antennal panel.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A phased array antenna panel comprising:

a plurality of antennas arranged in a plurality of antenna rows;

a plurality of row-shaped lenses;

at least one of said plurality of row-shaped lenses having a corresponding antenna row in said plurality of antenna rows;

said at least one of said plurality of row-shaped lenses providing a gain to said corresponding antenna row so as to increase a total gain of said phased array antenna panel;

said at least one of said plurality of row-shaped lenses and said corresponding antenna row being configured to be slanted in a desired angle based on signals received from a master chip in said phased array antenna panel, thereby changing a direction of an RF beam formed by said phased array antenna panel.

2. The phased array antenna panel of claim 1, further comprising:

a plurality of radio frequency (RF) front end chips;

wherein said master chip provides phase shift signals for said plurality of antennas through said plurality of RF front end chips.

3. The phased array antenna panel of claim 1, further comprising:

a plurality of radio frequency (RF) front end chips;

wherein said master chip provides amplitude control signals for said plurality of antennas through said plurality of RF front end chips.

4. The phased array antenna panel of claim 1, wherein said plurality of antennas and said master chip are integrated in a single printed circuit board (PCB).

5. The phased array antenna panel of claim 1, wherein said least one of said plurality of row-shaped lenses is configured to be slanted while being maintained in parallel with said corresponding antenna row in said plurality of antenna rows.

6. The phased array antenna panel of claim 1, wherein said corresponding antenna row in said plurality of antenna rows is configured to be slanted by a piezo-actuator.

7. The phased array antenna panel of claim 1, wherein said corresponding antenna row in said plurality of antenna rows is configured to be slanted by an electrostatic actuator.

8. The phased array antenna panel of claim 1, wherein said corresponding antenna row in said plurality of antenna rows is configured to be slanted by a microelectromechanical systems (MEMS) actuator.

9. The phased array antenna panel of claim 1, wherein said phased array antenna panel is a receiver, and said direction of said RF beam is substantially perpendicular to said corresponding antenna row.

10. The phased array antenna panel of claim 1, wherein said phased array antenna panel is a transmitter, and said direction of said RF beam is substantially perpendicular to said corresponding antenna row.

* * * * *